United States Patent [19]

Polakoff

[11] 4,408,261

[45] Oct. 4, 1983

[54] BATTERY OPERATED CHARM LIGHT

[76] Inventor: Frank Polakoff, 8140 Vanscoy Ave., North Hollywood, Calif. 91605

[21] Appl. No.: 340,235

[22] Filed: Jan. 18, 1982

[51] Int. Cl.[3] ..... F21L 15/08

[52] U.S. Cl. ..... 362/104; 362/203; 362/362; 362/800

[58] Field of Search ..... 362/104, 203, 362, 800

[56] References Cited

U.S. PATENT DOCUMENTS

| | | | |
|---|---|---|---|
| 3,790,715 | 2/1974 | Rosenblatt | 362/104 |
| 3,866,035 | 2/1975 | Richey | 362/104 |
| 4,035,630 | 7/1977 | Burke | 362/104 |
| 4,076,976 | 2/1978 | Fenton | 362/104 |
| 4,215,388 | 7/1980 | Reimann | 362/104 |
| 4,237,525 | 12/1980 | Deter | 362/104 |
| 4,296,459 | 10/1981 | DeLuca | 362/800 |
| 4,337,504 | 6/1982 | Simpson | 362/104 |

*Primary Examiner*—Stephen J. Lechert, Jr.
*Attorney, Agent, or Firm*—William W. Haefliger

[57] ABSTRACT

A charm carries a battery operated light, which may be turned on and off.

11 Claims, 8 Drawing Figures

BATTERY OPERATED CHARM LIGHT

BACKGROUND OF THE INVENTION

This invention relates generally to a charm light, and more particularly concern the construction of a lightweight, compact, simple, easily operated charm light which may be carried as on a bracelet, or as an ear pendant, other uses being possible.

There is a need for jewelry that incorporates lights; however, problems exist such as excessive weight, bulkiness, and cost. Also, if the light is to be controllable, there is need for "ON-OFF" circuitry and a switch or switches, which add undesirably to the complexity and expense. No prior way was known, to my knowledge, to overcome these problems and disadvantages in the unusual and surprising manner as now made possible by the present invention.

SUMMARY OF THE INVENTION

It is a major object of the invention to provide a charm light which meets the above need, and which is compact, lightweight, extremely simple in construction and operation, and which is highly attractive. Basically, the charm light comprises:

(a) a case to contain a battery having two terminals, (b) an LED carried by the case and having two leads one of which is located to always engage one battery terminal, (c) and a part movable to effect engagement and disengagement of the other lead with the other battery terminal.

Further, and as will appear, the movable part may comprise a cap on one end of the case which carries the light or LED, and which is movable between LED "ON" and "OFF" positions; a second and opposite end cap carried by the case is removable to allow battery insertion into the hollow case and removal therefrom; special notches in the case allow finger grasping of the caps to facilitate their movement relative to the case; and the cap surfaces are convexly curved to merge with the case walls, to form a unitary pendant shaped body. No switches are apparent from the body exterior, yet the LED is controllable by simply moving pendant body parts relative to one another, as will be seen.

These and other objects and advantages of the invention, as well as the details of an illustrative embodiment, will be more fully understood from the following description and drawings, in which:

DRAWING DESCRIPTION

DETAILED DESCRIPTION

Figure 7:
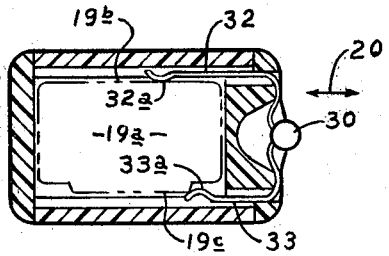
FIG. 7 is a section taken on lines 7—7 of FIG. 2.
Figure 8:
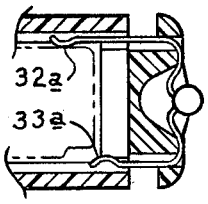
FIG. 8 is a fragmentary view like FIG. 7, but showing structure of the charm light in OFF condition.

In the drawings, the battery operated charm light generally indicated at 10 includes a compact, vertically elongated, hollow case 11 having top and bottom walls 12 and 13; two side walls 14 and 15; and a fixed end cap or back plate 16. A movable opposite end cap or front plate 17 is carried by the case to be movable in and out (see FIGS. 4 and 7 with the cap "in", and FIGS. 5 and 8 with the cap "out") relative to the case. See arrows 20. The case interior 18 is sized to closely receive a compact battery 19, the latter for example having a cylindrical outer wall 19*a*, and opposite sides 19*b* and 19*c* defining two terminals, respectively. Note that the outer wall 19*a* fits closely adjacent the case interior top and bottom walls 12*a* and 13*a*, and against fixed end cap interior wall 16*a*.

Figure 1:
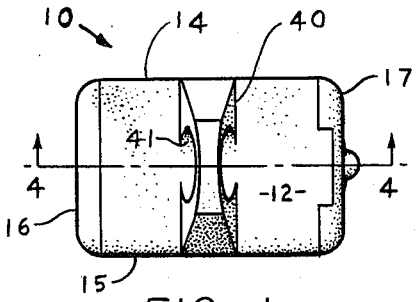
FIG. 1 is a top plan view of a charm light incorporating the invention.
Figure 2:
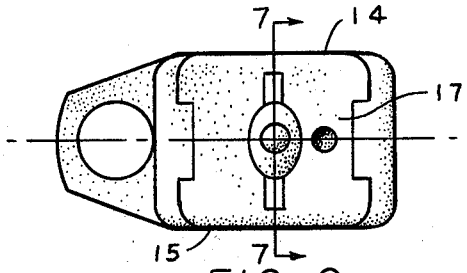
FIG. 2 is an end view on lines 2—2 of FIG. 1.
Figure 3:
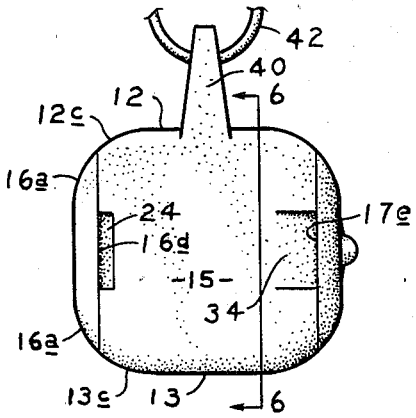
FIG. 3 is a side elevation on lines 3—3 of FIG. 1.

Cap 16 is at times removable to enable battery removal and replacement; however lugs 21 on the cap webs 22 snap into recesses 23 to retain the cap in fixed position. The cap 16 outer surface is convexly arcuate at 16*a* to merge with the arcuate surface portions 12*c* and 13*c*, of the case, as seen in FIG. 3. Local depressions or notches 24 in the case sidewalls 14 and 15 enable fingernail gripping of the cap local surfaces at 16*d* for pull-off removal of the cap 16, for battery replacement.

Figure 4:
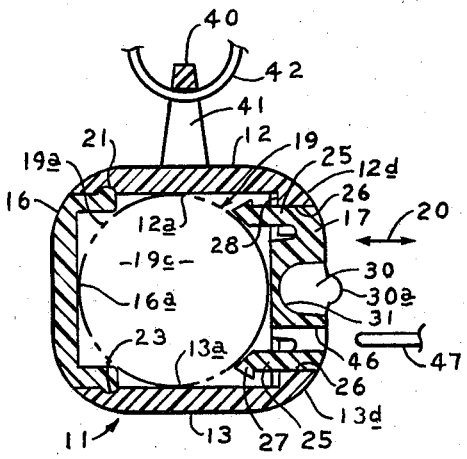
FIG. 4 is an elevation taken in section on lines 4—4 of FIG. 1.
Figure 5:
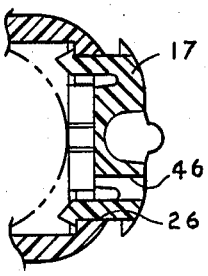
FIG. 5 is a fragmentary view like FIG. 4, but showing structure of the charm light in OFF condition.
Figure 6:
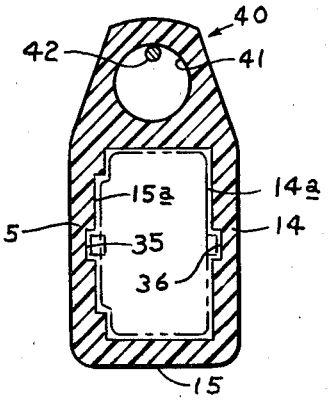
FIG. 6 is a section taken in elevation on lines 6—6 of FIG. 3.

Referring to the movable cap 17, it has channel shape, with webs 25 interfitting longitudinal extending guide surfaces 26 defined by the case, to guide in and out movement of that cap. Barbs 27 on those webs act as stops to interfit case shoulders 28, limiting pull-out movement of the cap at the position shown in FIG. 5, and in which the light (as for example LED 30) carried by that cap is "OFF". The LED is located in a recess 31 in the cap, so that its outermost extent 30*a* is almost flush with the convexly rounded surface 17*b* of the cap. That rounded surface merges with the rounded case surface portions 12*d* and 13*d*, in cap closed position as seen in FIG. 4.

The LED 30 has two rearwardly projecting leads 32 and 33, which are movable endwise with the cap 17. One lead, as for example 32, is longer than the other, and is located to always engage one battery terminal, i.e. terminal 19*b*, as the cap 17 moves back and forth. See FIGS. 7 and 8 in this regard. The other and shorter lead 33 engages battery terminal 19*c* in cap closed position (corresponding to LED "ON" condition), and disengages that terminal as the cap is moved forwardly to FIGS. 5 and 8 position (corresponding to LED "OFF" condition). Such cap movement is easily accomplished by grasping the cap edges 17*e* adjacent notches or depressions 34 in the case, as seen in FIG. 3. Note that the metallic leads may have in-turned ends at 32*a* and 33*a* to resiliently and yieldably bear against the battery terminals with spring clip force. Guide slots 35 and 36 in the case interior walls 14*a* and 15*a* may receive the leads for guided interaction therewith as the cap 17 moves back and forth.

A holder in the form of a tang 40 on the case upper wall 12 may be perforated at 41, for suspending the charm, as from the ear of a wearer, using a wire or clip 42 attachable to the ear. The case and caps may consists of lightweight molded synthetic resin or plastic material. The overall height of the case may be less than ½ inch.

Finally, a hole 46 in cap 17 allows penetration of a pin or pusher 47 to push out the battery 19, when cap 16 is removed.

I claim:

1. In a battery operated charm light, the combination, comprising (a) a case having a zone to contain a battery having two terminals spaced from the case, (b) an LED having two unequal length leads within the case and one of which is located to always engage one battery terminal, (c) and a part linearly movable back and forth relative to the case to effect engagement and disengagement of the other lead with the other battery terminal, said part comprising a cap for the end of the case and carried for movement toward and away from said zone, the LED carried by said cap.

2. The combination of claim 1 including a second cap for the case, said two caps located at opposite ends of the case, the second cap being removable to allow removal of the battery.

3. The combination of claim 2 including means to hold the first cap against complete removal from the case.

4. The combination of claim 1 wherein at least one of the said leads defines a guide to guide said part for linear movement.

5. The combination of claim 1 wherein both of said leads define two guides to guide said part for linear movement.

6. The combination of claim 1 wherein said cap embeds a substantial portion of said LED.

7. The combination of claim 1 including a holder on said case for suspending said case as a charm.

8. The combination of claim 1 including notch means in the case adjacent a graspable edge of the cap in a cap position closest to the case.

9. The combination of claim 2 including notch means in the case adjacent graspable edges of the two caps in positions thereof closest to the case.

10. In a battery operated charm light, the combination, comprising (a) a case to contain a battery having two terminals, (b) an LED carried by the case and having two leads one of which is located for electrical connection with one battery terminal, (c) and a part movable to effect electrical connection and disconnection of the other lead with the other battery terminal, (d) said part comprising a cap for the case and which carries said LED.

11. The combination of claim 10 including a second cap for the case, said two caps located at opposite ends of the case, the second cap being removable to allow removal of the battery.

* * * * *